US005897769A

United States Patent [19]

Trachte et al.

[11] Patent Number: 5,897,769

[45] Date of Patent: Apr. 27, 1999

[54] PROCESS FOR SELECTIVELY REMOVING LOWER MOLECULAR WEIGHT NAPHTHENIC ACIDS FROM ACIDIC CRUDES

[75] Inventors: Kenneth L. Trachte, Baton Rouge, La.; Winston K. Robbins, New Providence, N.J.

[73] Assignee: Exxon Research and Engineering Co., Florham Park, N.J.

[21] Appl. No.: 08/920,420

[22] Filed: Aug. 29, 1997

[51] Int. Cl.[6] ..... C10G 17/00

[52] U.S. Cl. ..... 208/263; 208/189

[58] Field of Search ..... 208/263, 264, 208/189

[56] References Cited

U.S. PATENT DOCUMENTS

| | | | |
|---|---|---|---|
| 2,734,019 | 2/1956 | Miller et al. | 196/24 |
| 2,921,023 | 1/1960 | Holm et al. | 208/263 |
| 3,617,501 | 11/1971 | Eng et al. | 208/60 |
| 3,876,532 | 4/1975 | Plundo et al. | 208/216 |
| 4,886,594 | 12/1989 | Miller | 208/216 |
| 4,941,964 | 7/1990 | Dai et al. | 208/216 |
| 5,358,634 | 10/1994 | Rankel | 208/216 |
| 5,468,709 | 11/1995 | Yamaguchi | 208/216 |
| 5,622,216 | 4/1997 | Porter et al. | 208/216 |
| 5,676,822 | 10/1997 | Sudhakar | 208/216 |

FOREIGN PATENT DOCUMENTS

| | | | |
|---|---|---|---|
| WO 96/06899 | 3/1996 | WIPO | C10G 45/50 |

*Primary Examiner*—Helane Myers
*Attorney, Agent, or Firm*—J H Takemoto

[57] ABSTRACT

A process for selectively removing lower molecular weight naphthenic acids from an acidic crude by treating the crude with a small pore hydrotreating catalyst at temperatures of from about 200° to 370° C. Removing these lower molecular weight naphthenic acids reduces the corrosive nature of acidic crudes.

7 Claims, 3 Drawing Sheets

PROCESS FOR SELECTIVELY REMOVING LOWER MOLECULAR WEIGHT NAPHTHENIC ACIDS FROM ACIDIC CRUDES

FIELD OF THE INVENTION

This invention relates to a process for selectively removing lower molecular weight naphthenic acids from high acid crude oils.

BACKGROUND OF THE INVENTION

Because of market constraints, it is becoming more necessary to process highly acidic crudes such as acidic naphthenic crudes, It is well known that processing such acidic crudes can lead to various problems associated with naphthenic and other acid corrosion. A number of methods to reduce the Total Acid Number (TAN), which is the number of milligrams of potassium hydroxide required to neutralize the acid content of one gram of crude oil, have been proposed.

One approach is to chemically neutralize acidic components with various bases. This method suffers from processing problems such as emulsion formation, increase in concentration of inorganic salts and additional processing steps. Another approach is to use corrosion-resistant metals in processing units. This, however, involves significant expense and may not be economically feasible for existing units. A further approach is to add corrosion inhibitors to the crudes. This suffers from the effects of the corrosion inhibitors on downstream units, for example, insufficient coverage of entire metal surface, lowering of catalyst life/efficiency and potential product quality impacts. Another option is to lower crude acid content by blending the acidic crude with crudes having a low acid content. The limited supplies of such low acid crudes makes this approach increasingly difficult.

U.S. Pat. No. 3,617,501 discloses an integrated process for refining whole crude. The first step is a catalytic hydrotreatment of the whole crude to remove sulfur, nitrogen, metals and other contaminants. U.S. Pat. No. 2,921,023 is directed to maintaining catalyst activity during mild hydrotreating of organic materials. The catalyst is molybdenum on a silica/alumina support wherein the feeds are heavy petroleum fractions. U.S. Pat. No. 2,734,019 describes a process for treating a naphthenic lubricating oil fraction by contacting with a cobalt molybdate on a silica-free alumina catalyst in the presence of hydrogen to reduce the concentration of sulfur, nitrogen and naphthenic acids. U.S. Pat. No. 3,876,532 relates to a very mild hydrotreatment of virgin middle distillates in order to reduce the total acid number or the mercaptan content of the distillate without greatly reducing the total sulfur content using a catalyst which has been previously deactivated in a more severe hydrotreating process.

It would be desirable to reduce the acidity of crude oils without the addition of neutralization/corrosion protection agents and without first converting the crude into product streams.

SUMMARY OF THE INVENTION

This invention relates to the discovery that the corrosive nature of acidic crudes is reduced when the lower molecular weight naphthenic acids are removed, and that the concentration of such acids in acidic crudes and corresponding crude distillates can be selectively reduced using small pore hydrotreating catalysts. Accordingly, there is disclosed a process for selectively removing lower molecular weight naphthenic acids from an acidic crude containing a mixture of naphthenic acids which comprises contacting the acidic crude with a hydrotreating catalyst having a pore diameter less than about 85 Å at a temperature of from about 200° to about 370° C. whereby naphthenic acids having a molecular weight below about 450 are preferentially removed from the crude oil.

DETAILED DESCRIPTION OF THE INVENTION

Figure 1:
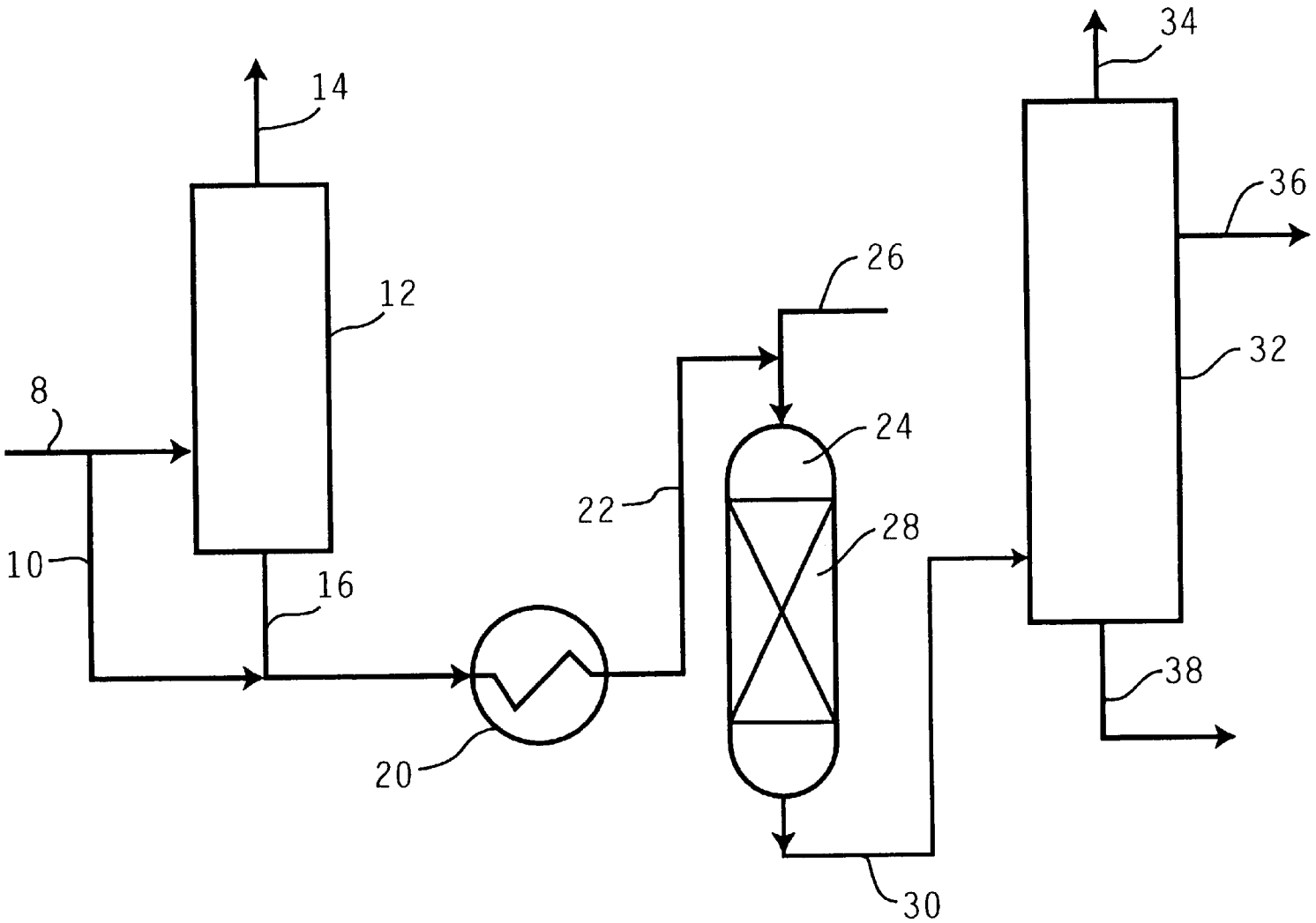
FIG. 1 is a schematic flow diagram of the process for reducing the acidity of crude oils.

Acidic crudes typically contain naphthenic and other acids and have TAN numbers of 1 up to 8. It has been discovered that the corrosivity of acidic crudes is diminished when lower molecular weight naphthenic acids are removed from the crude, i.e., naphthenic acids below about 450 molecular weight, especially those naphthenic acids between about 250 to about 450 molecular weight.

Selective removal of lower molecular weight naphthenic acids can be accomplished using small pore hydrotreating catalysts. By small pore is meant hydrotreating catalysts having pore diameters less than about 85 Å, particularly those having pore sizes in the range from 50 to 85 Å. Such small pore catalysts are thought to selectively hydrotreat the lower molecular weight naphthenic acids while leaving the heavier molecular weight naphthenic acids, i.e., those greater than about 450 molecular weight less reacted.

Hydrotreating catalysts are those containing Group VIB metals (based on the Periodic Table published by Fisher Scientific) and/or non-noble Group VIII metal. These metals or mixtures of metals are typically present as oxides or sulfides on refractory metal supports. Examples of such catalysts are cobalt and molybdenum oxides on a support such as alumina. Other examples include cobalt/nickel/molybdenum oxides or nickel/molybdenum oxides on a support such as alumina. Such catalysts are typically activated by sulfiding prior to use. Preferred catalysts include cobalt/molybdenum (1–5% Co as oxide, 5–25% Mo as oxide), nickel/molybdenum (1–5% Ni as oxide, 5–25% Mo as oxide) and nickel/tungsten (1–5% Ni as oxide, 5–30% W as oxide) on alumina. Especially preferred are nickel/molybdenum and cobalt/molybdenum catalysts such as KF-840 and KF-756 which are commercially available from Akzo Nobel.

Suitable refractory metal supports are metal oxides such as silica, alumina, titania or mixtures thereof. Low acidity metal oxide supports are preferred in order to minimize hydrocracking and/or hydroisomerization reactions. Particularly preferred supports are porous aluminas such as gamma or beta aluminas having average pore sizes of from 50 to 300 Å, a surface area of from 100 to 400 $m^2/g$ and a pore volume of from 0.25 to 1.5 $cm^3/g$.

Reaction conditions for contacting acidic crude with hydrotreating catalysts include temperatures of from about 200° to 370° C., preferably about 230° to 315° C. and most preferably from about 246° to 288° C., and a LHSV of from 0.1 to 10, preferably 0.3 to 4. While the process according to the invention uses a small pore hydrotreating catalyst, it is not necessary that hydrogen be present. Thus the amount of hydrogen pressure may range from about 0 to 2000 psi (0 to 13790 kPa). It is preferred to add hydrogen to the present process. Preferred amounts of hydrogen are from 50 to 500 psi (345 to 3450 kPa). The hydrogen:crude feed ratio is from 0 to 5000 scf/B, preferably from 30 to 1500 scf/B, most preferably 50 to 500 scf/B.

In a typical refining process, crude oil is first subjected to desalting. The crude oil may then be heated and the heated crude oil conducted to a pre-flash tower to remove most of the products having boiling points of less than about 100° C. prior to distillation in an atmospheric tower. This reduces the load on the atmospheric tower. Thus crude oil as used herein includes whole crudes and topped crudes.

The present process for reducing the acidity of highly acidic crudes utilizes a heat exchanger and/or furnace, and a catalytic treatment zone prior to the atmospheric tower. The heat exchanger preheats the crude oil. The heated crude is then conducted to a catalytic treatment zone which includes a reactor and catalyst. The reactor is preferably a conventional trickle bed reactor wherein crude oil is conducted downwardly through a fixed bed of catalyst. If desired, hydrogen may be added to the reactor.

The process of the invention is further illustrated by FIG. 1. Crude oil which may be preheated is conducted through line 8 to pre-flash tower 12. Overheads containing gases and liquids such as light naphthas are removed from the pre-flash tower through line 14. The remaining crude oil is conducted through line 16 to heater 20. Alternatively, crude oil may be conducted directly to heater 20 via lines 10 and 16. The heated crude oil from heater 20 is then conducted to reactor 24 via line 22. The order of heater 20 and reactor 24 may be reversed provided that the crude oil entering reactor 24 is of sufficient temperature to meet the temperature requirements of reactor 24. In reactor 24, crude oil is contacted with a bed of hot catalyst 28. Crude oil flows downwardly through the catalyst bed 28 and is conducted through line 30 to atmospheric tower 32. If desired, hydrogen may be added to reactor 24 through line 26. Atmospheric tower 30 operates in a conventional manner to produce overheads which are removed through line 34, various distillation fractions such as heavy virgin naphtha, middle distillates, heavy gas oil and process gas oil which are shown as collectively removed through line 36. Reduced crude is removed through line 38 for further processing in a vacuum distillation tower (not shown).

In reactor 24, the TAN of the crude oil is catalytically reduced by preferentially converting lower molecular weight naphthenic acidic components in the crude oil to produce CO, $CO_2$, $H_2O$ and lower acidity hydrocarbon product. The reactor conditions in reactor 24 are such that there is very little if any aromatic ring saturation occurring even in the presence of added hydrogen. These mild reactor conditions are also insufficient to promote hydrocracking or hydroisomerization reactions. If hydrogen is present, there is some conversion of reactive sulfur, i.e., non-thiophene sulfur, to $H_2S$ as process temperature is increased.

The invention is further illustrated by the following non-limiting examples.

EXAMPLE 1

This example is directed to the reduction of lower molecular weight naphthenic acids present in a high acid crude. A pilot unit was loaded with KF-756, a nominally small pore cobalt/molybdenum catalyst commercially available from Akzo Nobel. Crude oil was run through the unit for 7 to 10 days at each temperature condition of 232° C. (450° F.), 260° C. (500° F.), 288° C. (550° F.) and 316° C. (600° F.) with a hydrogen pressure of 100 psig (791 kPa) $H_2$, a LHSV of 2, and a hydrogen to feed treat ratio of 100 scf/B. The results are shown in Table 1.

TABLE 1

Naphthenic Acid Distributions in HydroSweetened High TAN Crude

| Sample | | TAN mgKOH/g | Whole Crude Naphtenic Acid Distribution 250 mn wt. % | 300 mw wt. % | 400 mw wt. % | 450 mw wt. % | 600 mw wt. % | 750 mw wt. % | TOTAL wt. % |
|---|---|---|---|---|---|---|---|---|---|
| 1[a] | Crude | 4.3 | 0.22 | 0.71 | 0.13 | 0.86 | 0.80 | 0.64 | 3.53 |
| | % Distribution | | 6.2% | 20.1% | 3.7% | 24.4% | 22.7% | 18.1% | |
| 232C/2LHSV/791kPa H2 | | | | | | | | | |
| 2[b] | | 3.4 | 0.16 | 0.53 | 0.11 | 0.73 | 0.73 | 0.55 | 2.97 |
| | % Remaining | 79.1% | 72.7% | 74.6% | 84.6% | 84.9% | 91.3% | 85.9% | 84.1% |
| | % Distribution | | 5.4% | 17.8% | 3.7% | 24.6% | 24.6% | 18.5% | |
| 260C/2LHSV/791kPa H2 | | | | | | | | | |
| 3[c] | | 2.3 | 0.08 | 0.35 | 0.07 | 0.58 | 64.0 | 0.56 | 2.44 |
| | % Remaining | 53.5% | 36.4% | 49.3% | 53.8% | 67.4% | 80.0% | 87.5% | 69.1% |
| | % Distribution | | 3.3% | 14.3% | 2.9% | 23.8% | 26.2% | 23.0% | |
| 288C/2LHSV/791kPa H2 | | | | | | | | | |
| 4[d] | | 0.92 | 0.02 | 0.08 | 0.02 | 0.26 | 0.45 | 0.62 | 1.42 |
| | % Remaining | 21.4% | 6.8% | 10.6% | 15.4% | 29.7% | 55.6% | 96.9% | 40.2% |
| | % Distribution | | 1.1% | 5.3% | 1.4% | 18.0% | 31.3% | 43.7% | |
| 316C/2LHSV/791kPa H2 | | | | | | | | | |
| 5[e] | | 0.36 | 0.01 | 0.03 | 0.01 | 0.06 | 0.17 | 0.39 | 0.67 |
| | % Remaining | 8.4% | 4.5% | 4.2% | 7.7% | 7.0% | 21.3% | 60.9% | 19.0% |
| | % Distribution | | 1.5% | 4.5% | 1.5% | 9.0% | 25.4% | 58.2% | |

Figure 2:
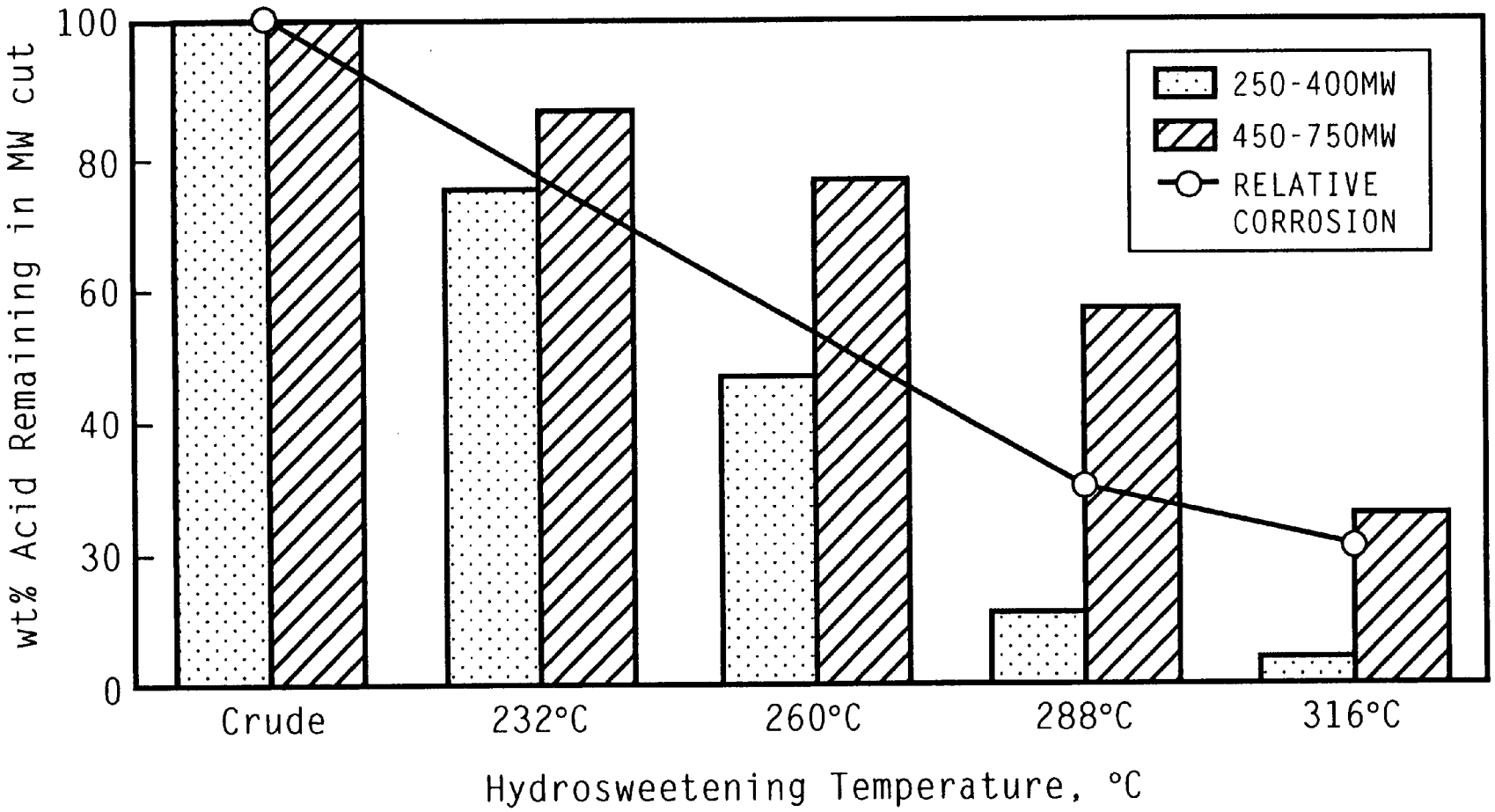
FIG. 2 is a graph showing the selective removal of naphthenic acids and corrosion reduction as a function of molecular weight for a crude oil run at different temperatures.

Table 1 shows that by increasing the temperature while holding other factors constant, the amount of 250–400 molecular weight naphthenic acids is progressively reduced with a concommitant reduction in TAN for these naphthenic acids. Above 400 molecular weight, the TAN reductions are less pronounced, although there is no sharp break-point as one goes to higher molecular weight acids. This is illustrated in FIG. 2 which is a plot of the weight percent of acids remaining for the 250–400 and 450–750 molecular weight naphthenic acid cuts, as tabulated from Table 1. Model fatty acids were used to define carbon number distributions and subsequent molecular weights were determined from high pressure liquid chromatography analyses.

Also shown are relative corrosion rates, measured in laboratory autoclave tests, for the crude oil and hydrotreated crude products from the 288° C. and 316° C. conditions. Whereas crude oil corrosion reduction is significant when hydrotreated at 288° C., the additional corrosion reduction achieved at 316° C. condition is much more modest. While not a definitive result, the incremental reduction in corrosion (8%) more closely follows the additional decrease in 250–400 molecular weight acids (6%) rather than the much greater reduction in 450–750 molecular weight acids (30%).

EXAMPLE 2

This example is directed to the resulting reduction of lower molecular weight naphthenic acids in the gas oil cuts as a result of the whole crude hydrotreating described in example 1. The gas oils were distilled from the respective crude and hydrotreated crude product.

TABLE 2

Naphthenic Acid Distributions in HydroSweetened High TAN Crude

| | | 343/471 Gas Oil Cut Naphtenic Acid Distribution | | | | | | |
|---|---|---|---|---|---|---|---|---|
| Sample | TAN mgKOH/g | 250 mn wt. % | 300 mw wt. % | 400 mw wt. % | 450 mw wt. % | 600 mw wt. % | 750 mw wt. % | TOTAL wt. % |
| Crude | 5.62 | 0.30 | 1.55 | 0.36 | 0.92 | 0.07 | 0.04 | 3.24 |
| % Distribution | | 9.3% | 47.8% | 11.1% | 28.4% | 2.2% | 1.2% | |
| 232C/2LHSV/791kPa H2 | | | | | | | | |
| | 4.24 | 0.34 | 1.07 | 0.22 | 0.69 | 0.09 | 0.00 | 2.41 |
| % Remaining | 75.4% | 100.0% | 69.0% | 61.1% | 75.0% | 100.0% | 0.0% | 74.4% |
| % Distribution | | 14.1% | 44.4% | 9.1% | 28.6% | 3.7% | 0.0% | |
| 288C/2LHSV/791kPa H2 | | | | | | | | |
| | 0.96 | 0.05 | 0.27 | 0.06 | 0.32 | 0.03 | 0.19 | 0.92 |
| % Remaining | 17.1% | 16.7% | 17.4% | 16.7% | 34.8% | 42.9% | 100.0% | 28.4% |
| % Distribution | | 5.4% | 29.3% | 6.5% | 34.8% | 3.3% | 20.7% | |
| 316C/2LHSV/791kPa H2 | | | | | | | | |
| | 0.16 | 0.04 | 0.09 | 0.04 | 0.11 | 0.00 | 0.00 | 0.28 |
| % Remaining | 2.8 | 13.3% | 5.8% | 11.1% | 12.0% | 0.0% | 0.0% | 8.6% |
| % Distribution | | 14.3% | 32.1% | 14.3% | 39.3% | 0.0% | 0.0% | |

Table 2 shows that like the whole crude product, the 250–400 molecular weight acids are also preferentially removed from the gas oil boiling range samples, although the absolute amount of each are different than for the whole crude samples, i.e., the gas oils have proportionately less acids greater than 600 molecular weight.

Figure 3:
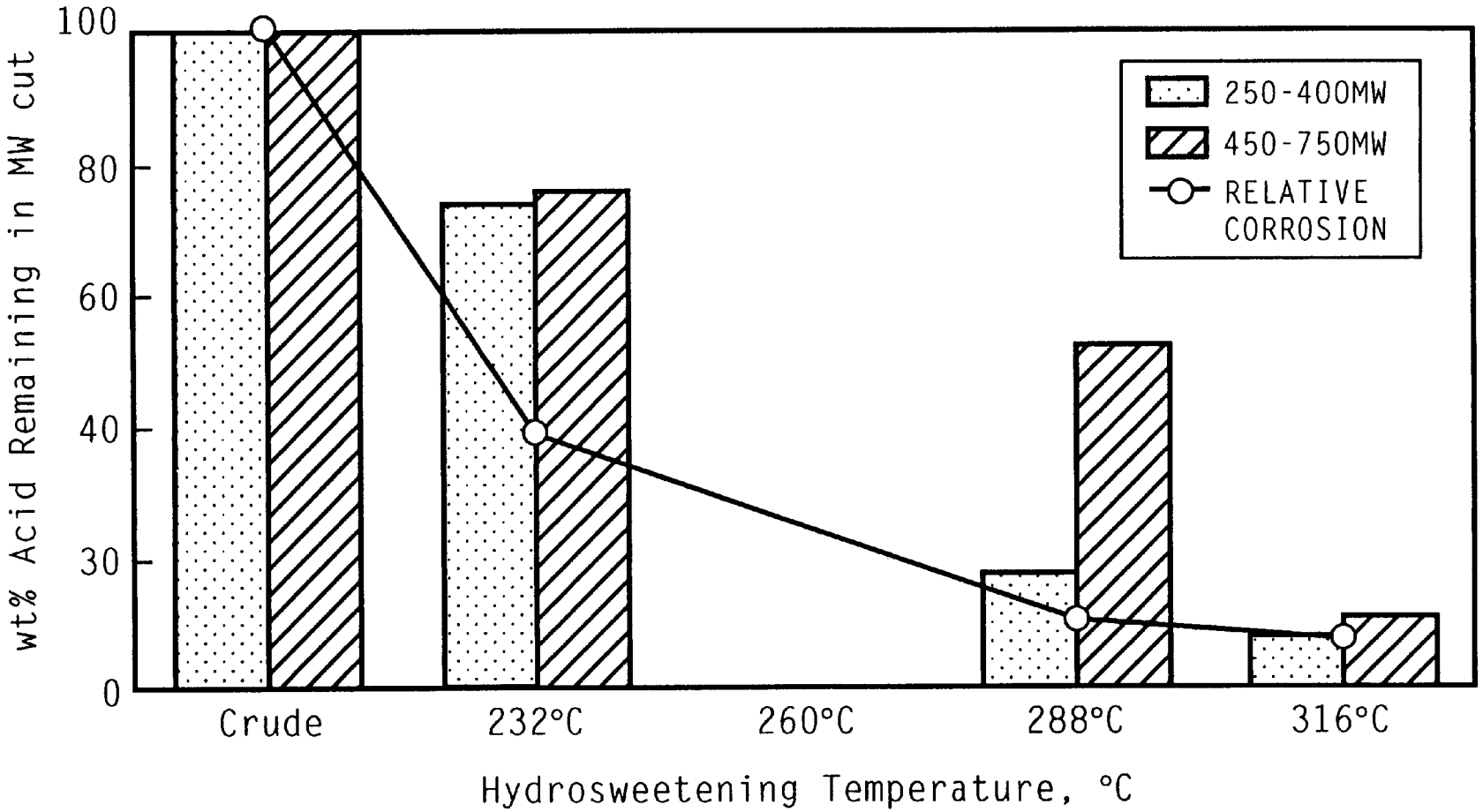
FIG. 3 is a graph showing the selective removal of naphthenics acids and corrosion reduction as a function of molecular weight for a gas oil.

The corresponding relative corrosion rates for the gas oil cuts are shown in FIG. 3. Like the whole crude, corrosion rate is reduced significantly as hydrotreating temperature is increased. Also like the whole crude, corrosion reduction best follows the decrease in the 250–400 molecular weight acid fraction. Increasing hydrotreating temperature from 232° C. to 288° C. decreased corrosion by a factor or 4. Over this same temperature change, the 250–400 molecular weight decreased nearly 60%, while the 450–750 molecular weight acids decreased only 10%. Conversely as hydrotreating temperature was raised further from 288° C. to 316° C., gas oil corrosion only decreased an additional 3%. The corresponding 250–400 molecular weight acids reduction was also low, only 10%, whereas the 450–750 molecular weight acids decreased over 40%, much greater than the corrosion rate response.

What is claimed is:

1. A process for selectively removing lower molecular weight naphthenic acids from an acidic crude selected from whole crudes and topped crudes and containing a mixture of naphthenic acids which comprises contacting the acidic crude with a hydrotreating catalyst consisting essentially of at least one Group VIB and non-noble Group VIII metal having a pore diameter between about 50 to about 85 Å at a temperature of from about 200 to about 370° C. whereby naphthenic acids of less than about 450 molecular weight are preferentially removed from the crude oil.

2. The process of claim 1 wherein the naphthenic acids preferentially removed from the crude oil have a molecular weight between about 250–400.

3. The process of claim 1 wherein the hydrotreating catalyst contains at least one of Co, Mo, Ni and W.

4. The process of claim 1 wherein the temperature is from about 230°–315° C.

5. The process of claim 1 wherein the LHSV is from 0.1 to 10.

6. The process of claim 1 wherein the hydrogen pressure is from 0 to 13790 kPa.

7. The process of claim 1 wherein the acidic crude has a total acid number between about 1 and 8.

* * * * *